US006135386A

United States Patent [19]

Garthaffner

[11] Patent Number: 6,135,386

[45] Date of Patent: Oct. 24, 2000

[54] BRAND FLEXIBLE TIPPING PAPER GUIDE

[75] Inventor: Martin T. Garthaffner, Chesterfield, Va.

[73] Assignee: Philip Morris Incorporated, New York, N.Y.

[21] Appl. No.: 09/156,645

[22] Filed: Sep. 18, 1998

[51] Int. Cl.[7] ..... B65H 57/04; B65H 23/00

[52] U.S. Cl. ..... 242/615.3; 242/615; 226/18

[58] Field of Search ..... 242/548, 566, 242/615, 615.1, 615.3; 226/196.1, 18

[56] References Cited

U.S. PATENT DOCUMENTS 3,131,843 5/1964 Bentley ..... 242/615.1
3,135,198 6/1964 Kingsley ..... 242/615.3 X
4,320,773 3/1982 Pinck et al. ..... 131/281
4,991,787 2/1991 Berg ..... 242/615.3 X
5,377,927 1/1995 Erickson et al. ..... 242/615.3 X

*Primary Examiner*—Michael R. Mansen
*Attorney, Agent, or Firm*—Charles E. B. Glenn; Kevin B. Osborne; Clinton H. Hallman, Jr.

[57] ABSTRACT

A brand flexible, fixed tipping paper guide including guide frame; a guide receivable in the guide frame; a register for aligning a first portion of the fame relative to a paper feed path and an adjustable mount operative to adjust a second portion of said guide frame transversely relative to said feed path.

23 Claims, 3 Drawing Sheets

BRAND FLEXIBLE TIPPING PAPER GUIDE

FIELD OF INVENTION

The present invention relates to apparatus and methods of producing cigarettes, and more particularly, methods and apparatus for the tipping of tobacco rods in the production of filter tipped cigarettes.

BACKGROUND OF INVENTION

An example of high speed cigarette tipping machines includes the Hauni Max-2 from Hauni Maschienenbaum of Hamburg, Germany, which is capable of tipping approximately 14,000 to 16,000 cigarettes per minute. Such machines include bobbin turntables and feed mechanisms for drawing continuous ribbons of tipping paper from a bobbin along a feed path passing through a feed roller group, a pivotal guide and a final guide roller upstream of adhesive applicators. Downstream of the adhesive applicators, the tipping paper is severed and placed in a position along the drum path of the tobacco rods, where pieces of tipping paper are wrapped about pre-positioned, two-up filter and tobacco rod assemblies so as to attach the filter plugs to the associated tobacco rods.

Such prior apparatus have been provided with automatic guide assemblies operatively located along the tipping paper feed path. In particular, the Hauni Max-2 has previously included a guide system comprising a rotatable table; a guide roller supported from the table; electronic tracking sensors operative at locations along the paper path; and yaw-inducing actuators for angulating the guide table and roller relative to the paper path responsively to signals generated by the sensors so as to maintain proper tracking of the tipping paper along the intended paper path. Such arrangements have typically included electro-pneumatic sensors and an electronic controller which cooperate with the rotatable table.

It has been found that the aforementioned guide systems not only added complication, but often induced undesired amounts of oscillation in the tipping paper. The complicated guide mechanism not only increased the risk of poor feeding of tipping paper, but also complicated repair when the tipping machine shut down. In particular, during shutdown, the operator has to resolve whether the problem arose from electronic malfunctions or mechanical problems. Such added to the downtime in most circumstances, creating production inefficiencies and adding costs to production.

Additionally, cigarette production machines must be configured to facilitate size-changes so that the machine may be switched from the production of cigarettes of one design and/or brand to the production of another, with minimal time and expense. Cigarettes of different design and/or brand include differences in tipping and tipping paper. Accordingly, there is a need of cigarette manufacturers to have their tipping machines adapted to accommodate speedy and effective adjustments for accommodating changes in tipping paper widths and other specifications between production runs. Once adjusted, the machines must also be capable of remaining properly set during the next production run.

Typically, tipping paper have a two-up width size in the range of 40 mm to 75 mm and various sizes therebetween, and typically bear a thickness in the range of approximately 0.015 inch.

OBJECTS AND SUMMARY OF THE INVENTION

Accordingly, an object of the present invention is to provide an arrangement and methodology for directing a continuous ribbon of tipping paper along a paper feed path with guidance in a manner which minimizes oscillations in the paper.

Another object is to provide guidance of a continuous ribbon of tipping paper through the operative portion of a tipping machine with minimum breakage and with effective alignment of the fed tipping paper along an intended feed path.

Still another object of the present invention is to provide apparatus and method for guiding cigarette tipping paper mechanically at high machine speeds so as to avoid confounding electronic issues in the instance of troubleshooting during downtime.

Still another object of the present invention is to provide method and apparatus for feeding cigarette tipping paper which facilitates size change for accommodating different brands and their associated different tipping paper widths.

Yet another object of the present invention is to provide method and apparatus for accommodating size-changes of tipping machines from one brand to another which minimizes down-time and expenses, yet is accurate and steadfast.

These and other objects of the present invention are provided with a brand flexible, tipping paper guide of an automated cigarette tipping machine, wherein a ribbon of tipping paper is directed along path, with the tipping paper guide comprising: a guide frame comprising a receiver portion and an arrangement for affixing the guide frame to a predetermined fixed portion of a tipping machine such that in an affixed condition, the receiver portion is in a superposing relation with the paper path. The tipping paper guide further comprises a guide insert comprising a guide channel portion and means for removably affixing the guide insert to the guide frame such that said guide insert is at least partially received by said receiver portion of said guide insert. The guide channel is adapted to slidingly receive tipping paper. The guide insert and the frame receiver portion are mutually configured such that upon affixing the guide insert to the guide frame, the guide insert is positionally registered by the receiver portion of the guide frame relative to the feed path.

The arrangement for affixing the guide frame to a predetermined fixed portion of the tipping machine preferably comprises a register at a first location along the guide frame, the register being operative upon a first portion of the guide frame so as to align the first portion of the guide frame relative to the feed path; and an adjustable mount at a second location along the guide frame, the mount operative to adjust a second portion of the guide frame transversely relative to the feed path.

By such arrangement, the tipping paper is effectively guided along the feed path at high machine speeds without electronic contribution. The guide is fixed, so once it is mounted, the guide assembly is not prone to shake loose or lose registration with the paper feed path. Between production runs, changes to the guide assembly for accommodating a change in tipping paper is effected by removing the old guide insert from the guide frame and fastening a new guide insert to the guide frame. Because the frame retains its registration with the paper feed path during the change, little or no adjustment of the guide assembly is needed, and if needed, is readily undertaken at the adjustable mount of the guide frame.

BRIEF DESCRIPTION OF THE DRAWING

The features and advantages of the present invention are well understood by reading the following detailed description in conjunction with the drawings in which like numerals indicate similar elements and in which.

DETAILED DESCRIPTION

Figure 1:
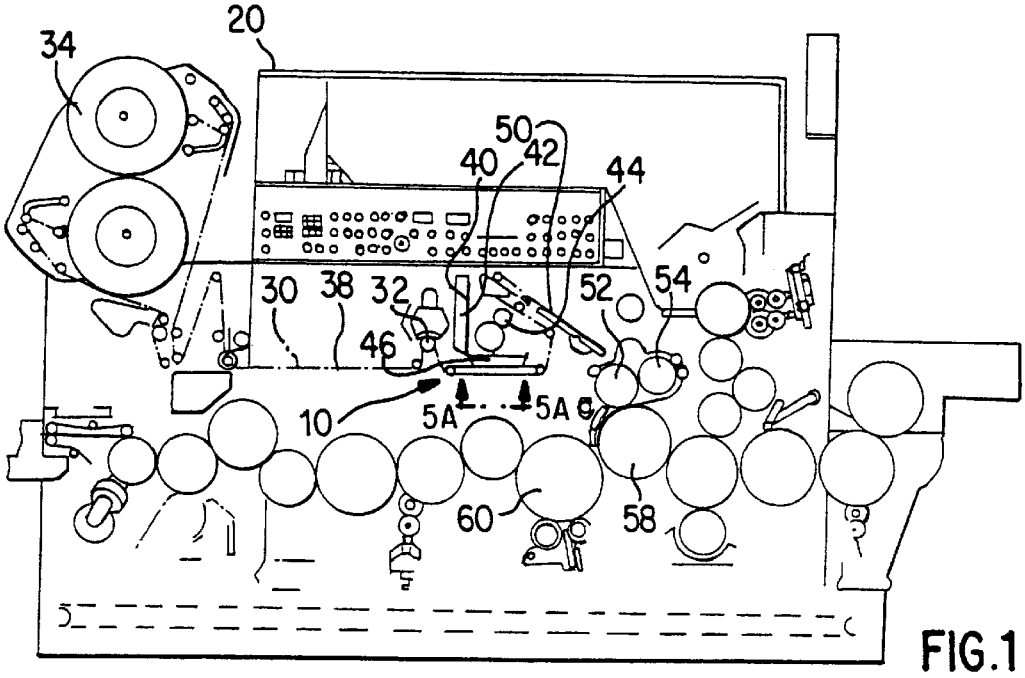
FIG. 1 is a schematic frontal view of a high speed cigarette tipping machine modified to include a preferred embodiment of the present invention.
Figure 3:
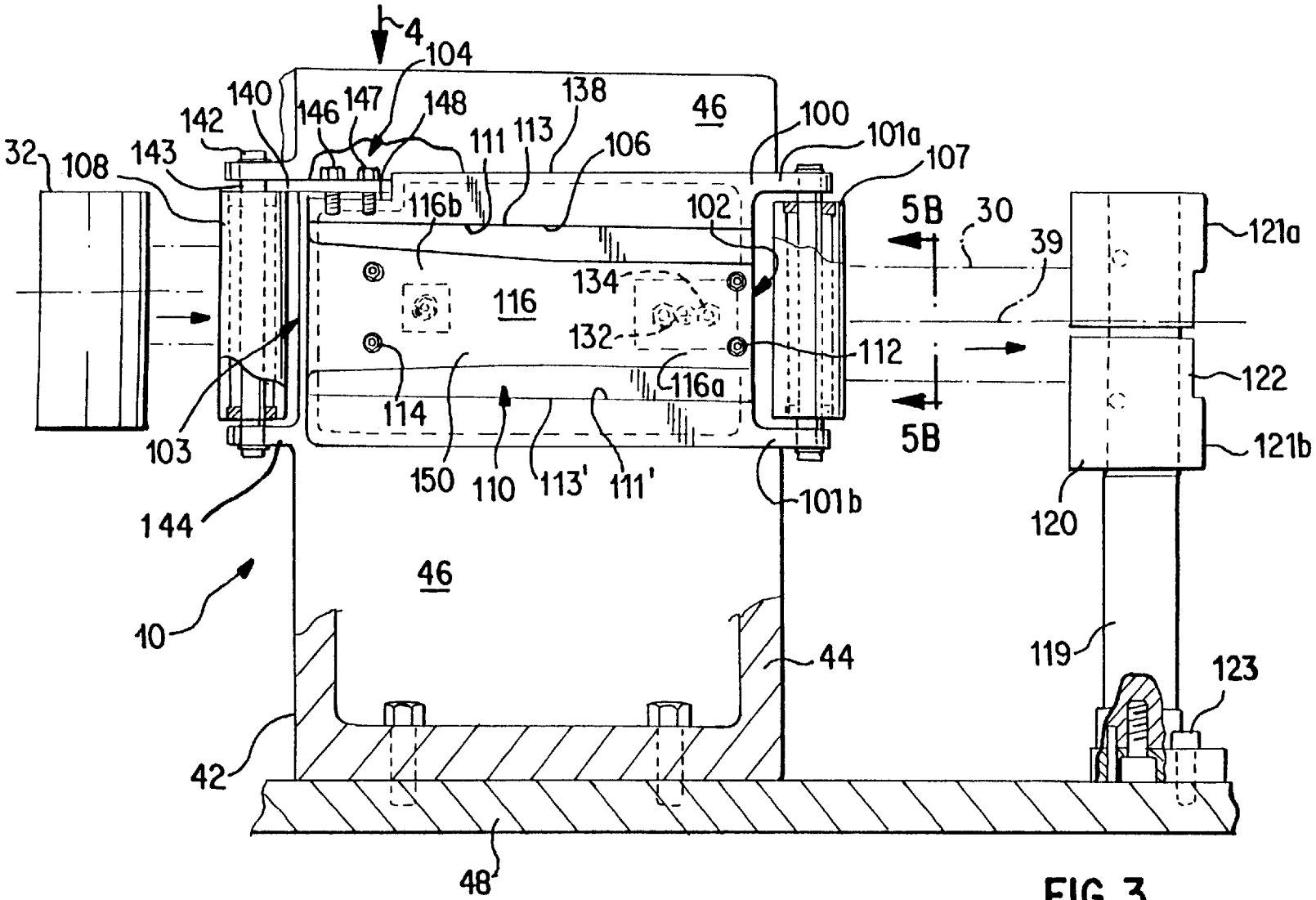
FIG. 3 is a planar bottom view of a brand flexible, fixed tipping guide assembly constructed in accordance with a preferred embodiment of the present invention.

Referring to FIGS. 1 and 3, a preferred embodiment of the present invention provides a brand-flexible, fixed tipping paper guide 10 particularly adapted for operations within a high speed tipping machine 20, such as for example the Hauni Max-2 tipping machine of the Hauni Maschienenbau AG, Hamburg, Germany.

Referring particularly to FIG. 1, the fixed tipping paper guide 10 is positioned at a location along a feed path of tipping paper 38 as the tipping paper 38 is drawn by a metering wheel 32 from a bobbin 34 of the tipping machine 20. The tipping paper guide assembly 10 constructed in accordance with a preferred embodiment of the present invention directs the continuous ribbon of tipping paper 38 beneath a glue roller housing 40. The glue roller housing 40 comprises an upper portion 42 which shields upstream portions of the paper path 38 from errant adhesive thrown from the adhesive applicators 44. The glue roller housing includes a lower housing portion 46, which is rigidly supported from the backside framework 48 of the tipping machine 20.

The description which follows will use orientations such as "front" and "back" in accordance with the convention typically understood by operators of tipping machinery, that the "front" of the cigarette tipping machine is the facade of the machine he or she faces during its operation and the "back" or "rear" of the machine is the opposite side. Additionally, reference to "upstream" and "downstream" is in reference to the direction of travel that the tipping paper 38 undertakes as it is drawn from the bobbin 34 by the metering wheel 32. With most tipping machines, the "upstream" and "downstream" orientation is transverse to the "front" and "back" orientation.

Returning to FIG. 1, after passing beneath the lower, horizontal glue roller housing 46, the paper 38 is drawn through the glue applicator 44 and subsequently past a heater station 50, suction rollers 52 and a tipping knife 54. At the swashplate plate drum 58, severed, two-up wide pieces tipping paper are placed adjacent assemblies of tobacco rods and two-up filter plugs and rolled thereabout on the rolling drum 60.

Figure 2:
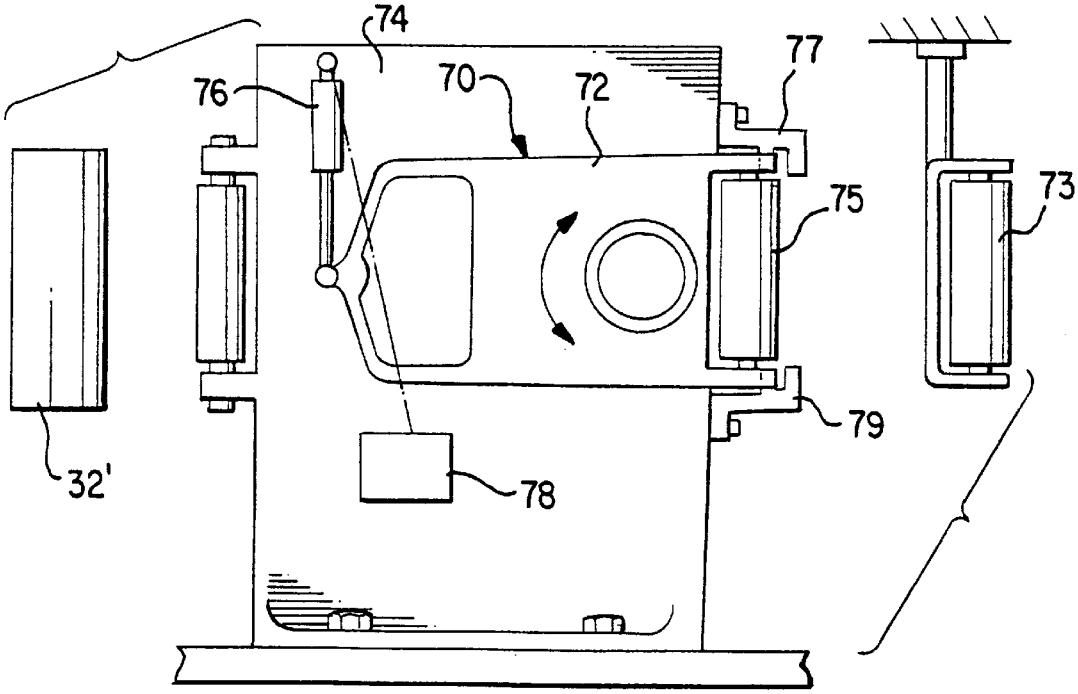
FIG. 2 PRIOR ART
FIG. 2 (prior art) is a planar bottom view of a pivotal tipping paper guide assembly constructed in accordance with prior practices.

Referring now to FIG. 2 (prior art), a practice of the prior art included a paper guide assembly 70 comprising a table 72 pivotally mounted to a glue roller housing 74 and a second connection with the glue roller housing 74 with an actuator 76. The actuator 76 is linked operatively to a control circuitry 78 which is configured to receive signals from edge sensors 77 and 79. Upon deflection of tipping paper transversely off the correct feed path, the sensors 77 and 79 communicate signals to a control circuit, which responsively causes the actuator 76 to pivot the table 72 and its the roller 75 in a manner compensating for the detected drift of the paper. Downstream of the pivotal roller 75 is a guide roller 73. Across this type of guide, only rollers contact the passing paper and the rollers are smooth and do not present of an edge to limit transverse motion or oscillation of the paper. As previously mentioned, malfunctions of this prior paper guide could originate from sources including the sensors, the electrical controller or mechanical components of the guide or combinations of same. The presence of alternative sources of trouble complicates trouble-shooting and exacerbates the risk of a malfunction. Additionally, this type of guide system is known to have operating characteristics (such as frequencies of dynamic response) which at certain operating conditions tend to contribute and/or exacerbate oscillations of the paper.

Figure 4:
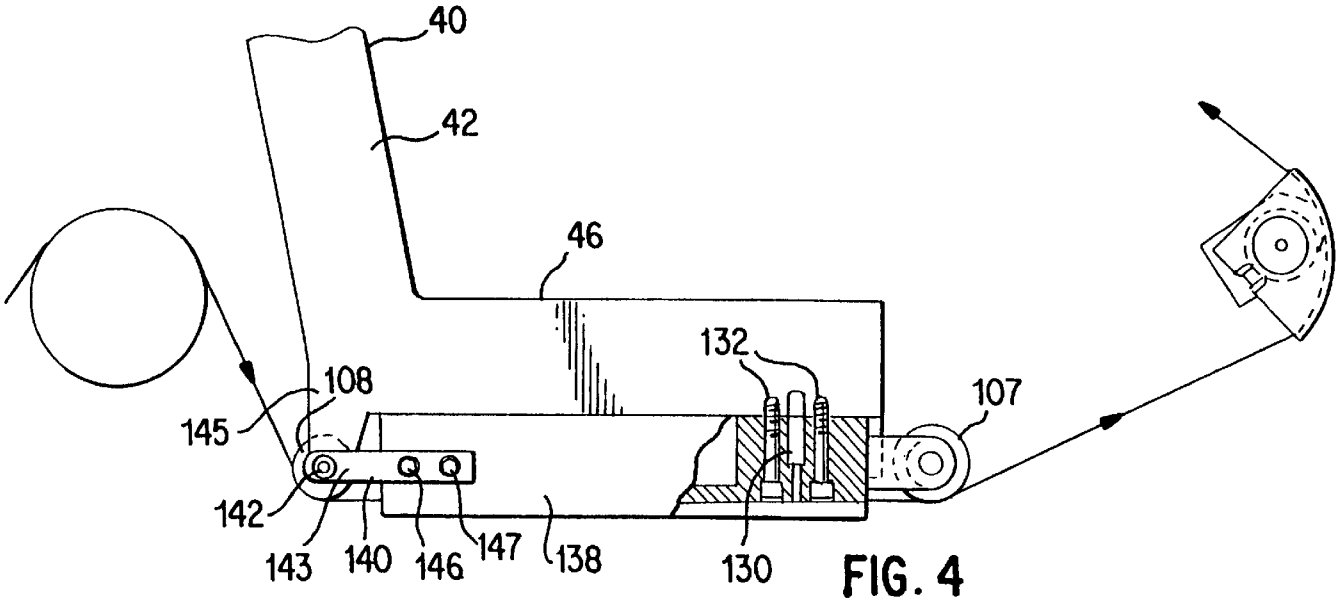
FIG. 4 is a planar side view of the tipping guide assembly shown in FIG. 3, with a cutaway view at a downstream end portion of its guide frame.
Figure 5B:
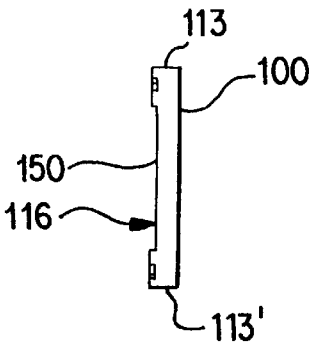
FIG. 5B is an end view of the tipping paper guide shown in FIG. 5A.
Figure 5A:
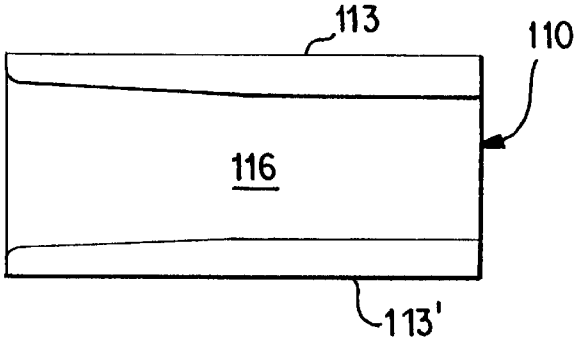
FIG. 5A is a bottom planar view of the tipping paper guide insert of the fixed tipping guide assembly shown in FIG. 3.

Referring now to FIGS. 3 and 4, the preferred embodiment of the present invention provides a brand flexible, fixed tipping paper guide assembly 10 comprising a guide frame 100 having a downstream frame portion 102 and an upstream frame portion 103. Preferably, the guide frame 100 is removably attachable to the lower horizontal portion of the glue roller housing 44 at generally two locations: preferably, with a twin bolt connection at a downstream frame portion 102 of the frame 100 and with an adjustable bracket assembly 104 along one side, preferably the front side, of the upstream frame portion 103. At the downstream end portion 102 of the guide frame 100 is a rotatable roller 107 held in fixed relation to the guide frame 100 by flanges 101*a* and 101*b* of the frame 100.

The guide frame 100 further includes a longitudinal recess 106 configured to receive a removable guide piece or insert 110. Preferably, the guide insert 110 and the recess 106 are provided with machined, mutually contacting, longitudinal edges 111 and 113 (and 111' and 113' along the other side), respectively, such that the fit between the two is precise and at close tolerances, preferably at tolerances of approximately 0.001 to 0.002 inches at each surface-to-surface interface. Preferably the guide insert 110 is attached to the guide frame 100 with a pair of bolts 112 at the forward end portion 102 of the guide frame 100 and by a second pair of bolts 114 at the upstream portion 103 of the guide frame 100. The guidepiece 110 includes a guide channel 116 which is positioned along a paper path 30 and slidingly receives the tipping paper 38 as it proceeds from the metering wheel 32 of the tipping machine 20 to the upstream roller 108 which is rotatably affixed to the lower horizontal portion of the glue roller housing 46.

Preferably, the fixed tipping paper guide assembly 10 further comprises a fixed guide piece 120 having an arcuate groove 122 for slidingly receiving the paper 38 and directing it toward the glue applicators as previously described. Preferably, the fixed guide piece 120 includes first and second lobes 121*a*, 121*b* whose transverse separation may be adjusted and locked with set screws or other expedient to adjust the transverse extent of the groove 122 to match the size (width) of the tipping paper 38. Preferably, the fixed guide piece 120 is attached to the backside frame portion 48 utilizing a pair of removable bolts 123 so that the entire guide 120, including its support portion 119 is replaceable as a unit. Preferably, a machine operator is provided with a set of fixed guide pieces 120, each being preset to accommodate tipping paper of a given width.

Still referring to FIGS. 3 and 4, the registration of the downstream portion 102 of the guide frame 100 along the center line 39 of the paper path 30 is achieved with a registration pin 130 between the downstream portion 102 of the guide frame 100 and an adjacent portion of the lower glue roller housing portion 46. Preferably, a pair of removable bolts 132 and 134 secure the connection at the forward portion 102 of the guide frame 100, which connection is tightened preferably after adjustments are undertaken at the upstream portion 103 of the guide frame 100 utilizing the bracket assembly 104 on the forward side 138 of the guide frame 100 . The connection of the removable bolts 132 and 134 includes sufficient play so that approximately 5° of angular motion (total sweep) may be made with the frame 100 about the registration pin 130.

The connection 104 between upstream portion 103 of the guide frame 100 and the lower glue roller housing portion 44 includes a bracket 140 which is fixed at one end 143 by the pin 142 which attaches the upstream roller 108 to the lower glue roller housing 46. Preferably, flanges 144 and 145 extend downwardly from the lower glue roller housing portion 46 with spacers provided between the upstream roller 108 and the flanges 144,145 so as to provide fixed axial placement of the roller 108 and the bracket 140 between the flanges 144,145.

Preferably, adjacent the opposite end of the bracket 140 are provided two or more removable bolts 146, 147 and a peelable brass shim 148 interposed between the end portion of the bracket 140 and the adjacent portion of the guide frame 100. Because the other end 143 of the bracket 140 is affixed relative to the lower glue roller housing portion 46 by the closely fitted connections between the pin 142, the upstream roller 108 and the flanges 144, pivotal adjustment of the upstream end 103 of the guide frame 100 is effected by the removal or addition of brass shims 148. Preferably, each removable shim element is approximately 0.002 inches thick.

Accordingly, in the preferred embodiment, the downstream portion 102 of the guide frame 100 is centered along the desired paper path 30 by registration of the pin 130 operatively between the lower glue roller housing portion 46 and the guide frame 100. The proper alignment of the other, upstream end 103 of the guide frame 100 is effected by transverse adjustments at the connection 108 along one side of the housing guide frame 100. Alignment of the upstream portion 103 of the guide frame 100 with the center line 39 of the paper path 30 is preferably undertaken by measurement from reference points at locations along the framework of the tipping machine 20, or by registration of alignment marks or other expediencies. Once aligned, the pair of bolts 146, 147 at the mounting bracket 140 and the pair of bolts 132 and 134 at the downstream portion 102 of the guide frame 100 are tightened so as to rigidly affix the guide frame 100 to the lower glue roller housing portion 46, with the guide receiving channel 106 being placed in a fixed, superposed relation with respect to the paper path 30.

Thereupon, the guide frame 100 is in position to receive attachment of the guide insert 110 by placement of the latter in the receiving channel 106 of the guide frame 100 and tightening the pairs of bolts 112, 114. Preferably, the guide assembly 10 is provided with a plurality of kits comprising interchangeable guide inserts 110 and corresponding sets of guide pieces 120 which are configured for receiving tipping paper of different, predetermined widths. When tipping paper width is to be changed, the operator need only loosen the removable bolts 112, 114, remove the first guide piece 110 and insert a new one having the desired size and reinserting and tightening the bolts 112, 114, all without disturbing alignment of the guide frame 100 with the centerline of the paper path 30. The guide piece 120 is changed similarly using the mounting bolts 123.

In the preferred embodiment, the guide insert 110 is provided with a guide channel 116 of a width closely matching that of the selected tipping paper width. Preferably, the downstream guide portion **116*a* of the channel 116 is 0.25 millimeter oversized relative to the nominal (specified) width of the tipping paper, such that for example, a tipping paper such having a width of 75 mm, the guide channel portion 116*a* would have a width of 75.25 mm. Preferably, the upstream portion of the guide channel 116 includes a convergent guide portion 116*b* to facilitate centering of the tipping paper 38 within the downstream guide channel portion 116*a***.

Preferably, the horizontal guide surface 150 of the guide channel 116 slidingly receives the paper 38, preferably along the substantial entirety of the guide channel 116. Furthermore, the guide surface 150 is preferably displaced vertically below the lower most edges of the upstream roller 120 and the downstream roller 107. Such arrangement assures substantial surface contact between the guide surface 150 and the paper 38 so as to effect the desired guidance and to help stabilize the paper. Preferably, the vertical displacement is approximately 0.5 mm to 1.0 mm lower than the lower-most roller edge.

Advantageously, the tipping paper guide assembly 10 of the preferred embodiment is fixed in position during operation of the tipping machine and provides the desired guidance of the tipping paper even at high machine speeds such as found with the Max-2 Hauni Tipping Machine. There are no electromechanical interactions and controllers, with guidance being effected by mechanical means without electronic input. Furthermore, to accommodate a change in production runs which necessitates a change of tipping paper, the guide insert 110 of a previous production run may be readily removed and replaced with a guide insert 110 of the desired size. Such may be undertaken expeditiously without removing the entire guide assembly 10. Advantageously, the guide assembly 10 slidingly receives the tipping paper 38 and presents edges which limits transverse motion in a manner that achieves positive guidance of the paper without inducing oscillations or other disturbances of the paper.

While this invention has been illustrated and described in accordance with a preferred embodiment, it is recognized that variations and changes may be made therein without departing from the invention as set forth in the claims. For example, releasable clamps or other locking mechanisms might be used instead of bolts for effecting connections of the guide frame, the guide insert and/or the mounting bracket. The invention is readily adaptable to a host of tipping machine other than the one specifically shown herein. Transverse adjustments of the guide frame may be undertaken with other types of spacers than that specifically shown, including threaded ones. The guide is also operable at locations other than that specifically shown in the preferred embodiment.

What it claimed is:

1. A tipping paper guide of an automated cigarette tipping machine, wherein a ribbon of tipping paper is directed in a downstream direction along path, said tipping paper guide comprising:

a guide frame comprising a receiver portion and an arrangement for affixing said guide frame to a predetermined fixed portion of a tipping machine, said guide frame being configured such that in an affixed condition, said receiver portion is in a fixed relation to a location along said paper path;

a guide insert comprising a guide channel portion and means for removably affixing said guide insert to said guide frame such that said guide insert is at least partially received by said receiver portion of said guide insert, said guide channel adapted to slidingly receive tipping paper, said guide insert and said receiver portion mutually configured such that upon affixing said guide insert to said guide frame, said guide insert is positionally registered with said location along said paper path by said receiver portion of said guide frame;

said arrangement for affixing said guide frame to a predetermined fixed portion of a tipping machine comprising:

a register at a first location along said guide frame, said register operative upon a first portion of said guide frame so as to align said first portion of said guide frame relative to said feed path; and an adjustable mount at a second location along said guide frame, said mount operative to adjust a second portion of said guide frame transversely relative to said feed path.

2. The tipping guide as claimed in claim 1, further comprising a roller rotatably supported from said guide frame and positioned adjacent said downstream portion of said guide frame.

3. The tipping guide as claimed in claim 2, wherein said adjustable mount comprises a bracket, a first end portion of said bracket affixable to a portion of said tipping machine, an opposite end portion of said bracket adjustably affixed with a side of said upstream portion of said guide frame.

4. The tipping guide as claimed in claim 3, wherein said adjustable mount includes a fastener in cooperation with a shim such that said shim transversely displaces said upstream guide frame portion relative to said feedpath.

5. The tipping paper guide as claimed in claim 1, wherein said guide channel includes a guide surface, said guide surface positioned further beneath said guide frame than a lower edge portion of said roller.

6. The tipping paper guide as claimed in claim 5, wherein said guide channel surface is displaced below said lower edge portion of said roller by a distance in the range of 0.5 to 1.0 mm.

7. The tipping paper guide as claimed in claim 1 further comprising a kit comprising a plurality of guide inserts, said guide inserts having guide channels of pre-selected widths.

8. A tipping paper guide system of an automated cigarette tipping machine, wherein a ribbon of tipping paper is directed in a downstream direction along path, said tipping paper guide system comprising:

a guide frame comprising a receiver portion and an arrangement for affixing said guide frame to a predetermined fixed portion of a tipping machine, said guide frame being configured such that in an affixed condition, said receiver portion is in a fixed relation to a location along said paper path;

a guide insert comprising a guide channel portion and means for removably affixing said guide insert to said guide frame such that said guide insert is at least partially received by said receiver portion of said guide insert, said guide channel adapted to slidingly receive tipping paper, said guide insert and said receiver portion mutually configured such that upon affixing said guide insert to said guide frame, said guide insert is positionally registered with said location along said paper path by said receiver portion of said guide frame;

said arrangement for affixing said guide frame to a predetermined fixed portion of a tipping machine comprising:

a register at a first location along said guide frame, said register operative upon a first portion of said guide frame so as to align said first portion of said guide frame relative to said feed path; and an adjustable mount at a second location along said guide frame, said mount operative to adjust a second portion of said guide frame transversely relative to said feed path;

said tipping paper guide system further comprising a guide piece assembly affixable to a second fixed portion of said tipping machine at a location along said feed path downstream of said guide frame, said guide including an arcuate groove of a predetermined width and configured to sliding receive tipping paper.

9. The tipping paper guide system as claimed in claim 8, further comprising a roller rotatably supported from said guide frame and positioned adjacent said downstream portion of said guide frame.

10. The tipping paper guide system as claimed in claim 9, wherein said adjustable mount comprises a bracket, a first end portion of said bracket affixable to a portion of said tipping machine, an opposite end portion of said bracket adjustably affixed with a side of said upstream portion of said guide frame.

11. The tipping paper guide system as claimed in claim 10, wherein said adjustable mount includes a fastener in cooperation with a shim such that said shim transversely displaces said upstream guide frame portion relative to said feedpath.

12. The tipping paper guide system as claimed in claim 9, wherein said guide channel includes a guide surface, said guide surface positioned further beneath said guide frame than a lower edge portion of said roller.

13. The tipping paper guide as claimed in claim 12, wherein said guide channel surface is displaced below said lower edge portion of said roller by a distance in the range of 0.5 to 1.0 mm.

14. The tipping paper guide as claimed in claim 9 further comprising a kit comprising a set of guide inserts and a corresponding set of guide piece assemblies, said guide inserts having guide channels of pre-selected widths, said guide piece assemblies having arcuate grooves of corresponding pre-selected widths.

15. A tipping paper feeder system in an automated cigarette tipping machine, wherein a ribbon of tipping paper is directed in a downstream direction along path, said tipping paper feeder system comprising:

a guide frame comprising a receiver portion and an arrangement removably affixing said guide frame to a predetermined fixed portion of said tipping machine, said guide frame being configured such that said receiver portion is in a fixed relation to a location along said paper path;

a guide insert comprising a guide channel portion and means for removably affixing said guide insert to said guide frame such that said guide insert is at least partially received by said receiver portion of said guide insert, said guide channel adapted to slidingly receive tipping paper, said guide insert and said receiver portion mutually configured such that upon affixing said guide insert to said guide frame, said guide insert is positionally registered with said location along said paper path by said receiver portion of said guide frame;

said arrangement affixing said guide frame to a predetermined fixed portion of a tipping machine comprising:

a register at a first location along said guide frame, said register operative upon a first portion of said guide frame so as to align said first portion of said guide frame relative to said feed path; and an adjustable mount at a second location along said guide frame, said mount operative to adjust a second portion of said guide frame transversely relative to said feed path;

said tipping paper feed system further comprising a guide piece assembly affixed to a second fixed portion of said tipping machine at a location along said feed path downstream of said guide frame, said guide piece assembly including an arcuate groove of a predetermined width and configured to slidingly receive tipping paper;

said tipping paper feed system further comprising a roller supported from a fixed portion of said tipping machine independent of said guide frame and at a location along said feed path upstream of said guide frame.

16. The tipping paper feeder system as claimed in claim 15 wherein the guide piece assembly is removably affixed to said second fixed portion of said tipping machine.

17. The tipping paper feeder system as claimed in claim 16 further comprising a kit comprising a set of guide inserts and a corresponding set of guide piece assemblies, said guide inserts having guide channels of pre-selected widths, said guide piece assemblies having arcuate grooves of corresponding pre-selected widths.

18. The tipping paper feeder system as claimed in claim 15, further comprising a roller rotatably supported from said guide frame and positioned adjacent said downstream portion of said guide frame.

19. The tipping paper feeder system as claimed in claim 18, wherein said adjustable mount comprises a bracket, a first end portion of said bracket affixed to a portion of said tipping machine, an opposite end portion of said bracket adjustably affixed with a side of said upstream portion of said guide frame.

20. The tipping paper feeder system as claimed in claim 19, wherein said adjustable mount includes a fastener in cooperation with a shim such that said shim transversely displaces said upstream guide frame portion relative to said feedpath.

21. The tipping paper feeder system as claimed in claim 15, wherein said guide channel includes a guide surface, said guide surface positioned further beneath said guide frame than a lower edge portion of said roller.

22. The tipping paper feeder system as claimed in claim 21, wherein said guide channel surface is displaced below said lower edge portion of said roller by a distance in the range of 0.5 to 1.0 mm.

23. The tipping paper feeder system as claimed in claim 15 further comprising a kit comprising a set of guide inserts, said guide inserts having guide channels of pre-selected widths.

* * * * *